US007703185B2

(12) United States Patent
Trail

(10) Patent No.: US 7,703,185 B2
(45) **Date of Patent: *Apr. 27, 2010**

(54) COMBINED HEADSTONE AND COLUMBARIUM

(76) Inventor: Nancy Trail, 4467 Old Pipestone Rd., Eau Claire, MI (US) 49111

( * ) Notice: Subject to any disclaimer, the term of this patent is extended or adjusted under 35 U.S.C. 154(b) by 0 days.

This patent is subject to a terminal disclaimer.

(21) Appl. No.: 12/134,423

(22) Filed: Jun. 6, 2008

(65) Prior Publication Data

US 2008/0229679 A1 Sep. 25, 2008

Related U.S. Application Data

(63) Continuation-in-part of application No. 11/300,235, filed on Dec. 14, 2005, now Pat. No. 7,406,754.

(51) Int. Cl.
*A61G 17/00* (2006.01)

(52) U.S. Cl. ..... 27/1; 52/103; 52/136

(58) Field of Classification Search ..... 27/1, 27/35; 52/103–104, 134, 136; 40/124.5; D99/19; 220/23.87
See application file for complete search history.

(56) References Cited

U.S. PATENT DOCUMENTS

| | | | |
|---|---|---|---|
| D89,766 | S | 5/1933 | Hull |
| 1,982,432 | A | 11/1934 | Hull |
| 2,075,859 | A | 4/1937 | Martin |
| 2,124,143 | A | 7/1938 | Long |
| 3,726,052 | A | 4/1973 | Thompson |
| D259,369 | S | 5/1981 | Splendora |
| 4,337,109 | A | 6/1982 | Narita |
| 4,521,999 | A | 6/1985 | Flanagan |
| 5,371,984 | A | 12/1994 | Taylor |
| 5,408,786 | A | 4/1995 | Konno |
| 5,546,710 | A | 8/1996 | Barry |
| 5,729,921 | A | 3/1998 | Rojas |
| 5,732,515 | A | 3/1998 | Rodrigues |
| 5,987,720 | A | 11/1999 | Yamamoto |
| 6,076,292 | A | 6/2000 | Kawa |
| 6,414,663 | B1 | 7/2002 | Manross |

(Continued)

FOREIGN PATENT DOCUMENTS

| | | |
|---|---|---|
| FR | 2681624 | 9/1991 |

(Continued)

*Primary Examiner*—William L. Miller
(74) *Attorney, Agent, or Firm*—Robert L. Judd

(57) ABSTRACT

A combination memorial and columbarium having a headstone, and an above ground base supporting the headstone. In an embodiment of the invention, one deceased person is interred in the earth ahead of the headstone, and the cremated remains of another deceased are secured in a chamber disposed in the headstone or the above-ground base. In an embodiment, at least two chambers are individually formed in an interior portion of the headstone. Each chamber has an opening providing access to the chamber and at least one of the chambers is adapted to securely hold the cremated remains of a deceased person or previously living being. Another chamber is adapted to securely and, in a sterile environment, hold the DNA material of one or more deceased individuals or previously living beings. In an embodiment, each chamber is further adapted to hold a container for securely enclosing the cremated remains of DNA of a deceased person. The chambers can either be in the headstone or the above ground base.

16 Claims, 3 Drawing Sheets

U.S. PATENT DOCUMENTS

| | | | |
|---|---|---|---|
| 6,463,703 | B1 | 10/2002 | Mattis |
| 6,904,721 | B1 | 6/2005 | Forbes |
| 2004/0085337 | A1 | 5/2004 | Barrows |
| 2004/0139633 | A1 | 7/2004 | Shannon |
| 2005/0144821 | A1 | 7/2005 | Griesemer et al. |

FOREIGN PATENT DOCUMENTS

| | | |
|---|---|---|
| JP | 2004100419 | 4/2004 |

COMBINED HEADSTONE AND COLUMBARIUM

CROSS REFERENCE TO RELATED APPLICATION

This application is a continuation-in-part of application Ser. No. 11/300,235 filed on Dec. 14, 2005, now U.S. Pat. No. 7,406,754, and incorporated herein by reference to the extent allowed by law.

BACKGROUND OF THE INVENTION

1. Field of the Invention

The present invention relates to memorial park monuments, and more particularly to a memorial monument comprising a combined burial headstone and base, where either the headstone or the base includes a columbarium compartment adapted to hold an urn, tube or other container-like structure encasing the cremated remains of a deceased person, or other formerly living creature. The present invention further includes an additional container-like structure adapted to hold the DNA material of a deceased. The combination of the present invention contemplates that at least one person will be interred in the ground ahead of the monument, while the remains of another deceased person or formerly living creature are maintained in the urn or tube.

The present invention provides a solution to the problem that arises when one or more family members desire to be buried through interment, while other family members desire to be cremated, and all family members desire to lie in their eternal rest in the same plot of land. The present invention also provides an option to have DNA material of a deceased person or other previously living being readily available inside the monument to avoid having to exhume a body after death to obtain a sample of DNA material.

2. Prior Art

Previously, grave monuments have been created for the purpose of a headstone marking the location of an individual interred in the earth ahead of the monument, with recessed or cut-out portions in the monument to display items such as flowers, photographs, memorabilia of the deceased, and even video displays describing salient features of the life of the deceased.

In addition, columbaria of various constructions provide a resting place for urns holding the cremated remains of a deceased loved one. These columbaria normally combine shelves in vertical extending walls forming niches for placement of many cremation urns, indoors or outdoors, some having glass covers over the niches so the urn may be viewed.

U.S. Pat. No. 2,124,143 to Long discloses a transparent monument for use as a headstone, having a transparent casting or plate disposed in an opening in the monument. The casting or plate has identifying indicia applied thereto. There is no teaching in the Long patent of lodging the cremated remains of an individual in the monument structure.

U.S. Pat. No. 5,546,710 to Barry discloses a customized memorial structure comprising recessed portions formed in the front wall of the monument. The Barry patent indicates that these recesses could be used to contain items such as molded figures, sports objects, and pet likenesses. There is no teaching in the Barry patent that the monument can be constructed to commemorate the lives of two individuals, one cremated whose remains are lodged in the monument, and one who chose earthen interment.

U.S. Pat. No. 6,076,292 to Kawa discloses a cremains container that extends above the ground to provide a grave marker identifying the cremated individual. The cremains container can also hold memorabilia of the deceased. In the Kawa patent, the marker only identifies the single cremated remains. This patent does not teach a monument for identifying the deceased individuals, one whose cremated remains are disposed in the monument, and the other whose remains were interred in the earth.

U.S. Design Pat. No. D89,766 to Hull discloses a burial monument with a compartment for removably holding a portrait and vases. There is no disclosure in the Hull reference that the monument comprises structure to securely house the cremated remains of one individual who is identified on the monument, and to identify a second individual who chose earthen interment with the monument holding the cremated remains also functioning as a headstone identifying the second individual.

French Patent No. 91, 11567 discloses a process for cutting a core or cores from a tombstone or tombstone slab, cutting discs from the core, hollowing the core, and creating urns from the core with the discs used to cap the urns. French Patent No. 91, 11567 does not appear to disclose a headstone that is supported by the base above ground, and a base that seals openings to a chamber individually formed in the headstone. Additionally, there is no disclosure in the French patent of two chambers or urns in an inner portion of the headstone, one of which is adapted to hold the DNA material of a previously living being, the other adapted to hold the cremated remains of a previously living being.

U.S. Pat. No. 6,904,721 to Forbes discloses a marker and cremated remains holder base that is placed underground. Forbes does not disclose a separate headstone and a base, the base supporting the headstone, a chamber in the headstone, the chamber having an opening communicating with the bottom of a headstone, and the base sealing the opening when the headstone is supported by the base. Additionally, Forbes does not disclose two chambers or urns in an inner portion of the headstone, one of which is adapted to hold the DNA material of a previously living being, the other adapted to hold the cremated remains of a previously living being.

U.S. Pat. No. 6,463,703 to Mattis discloses a burial monument and memorabilia storage compartment mounted on a base. Again, Mattis does not disclose a chamber or urn in the headstone, the chamber having an opening communicating with the bottom of a headstone, and the base sealing the opening when the headstone is supported by the base. Mattis also does not disclose two chambers or urns in an inner portion of the headstone, one of which is adapted to hold the DNA material of a previously living being, the other adapted to hold the cremated remains of a previously living being.

As a review of the prior art reveals, headstones which also provide an option to hold the DNA material of a deceased individual in combination with the cremated remains of the same or another individual, are not found nor suggested in the prior art.

SUMMARY OF THE INVENTION

In accordance with the present invention, a monument comprising a combination headstone and above ground base is provided to mark the resting place of one who is earthen interred, and to also hold the remains of another who chose to be cremated. The single monument comprises a headstone and an above ground base supporting the headstone. In an embodiment, at least two chambers are individually formed in an interior portion of the headstone or the base. Each chamber has an opening providing access to the chamber and at least one of the chambers is adapted to securely hold the cremated remains of a deceased person or previously living being. Another of the chambers is adapted to securely and, in a sterile environment, hold the DNA material of one or more deceased individuals or previously living beings. In another embodiment, each chamber is further adapted to hold a container securely enclosing the cremated remains or sterile DNA material of a deceased person.

These and other novel features and advantages of the present invention will be more readily understood from the following detailed description read in association with the accompanying drawings.

BRIEF DESCRIPTION OF THE DRAWINGS

The invention may take various forms, embodiments and arrangements. The drawings are for the sole purpose of illustrating various embodiments of the invention, and are not to be construed as limiting the invention defined in the claims.

DETAILED DESCRIPTION OF THE ILLUSTRATED EMBODIMENTS

Figure 1:
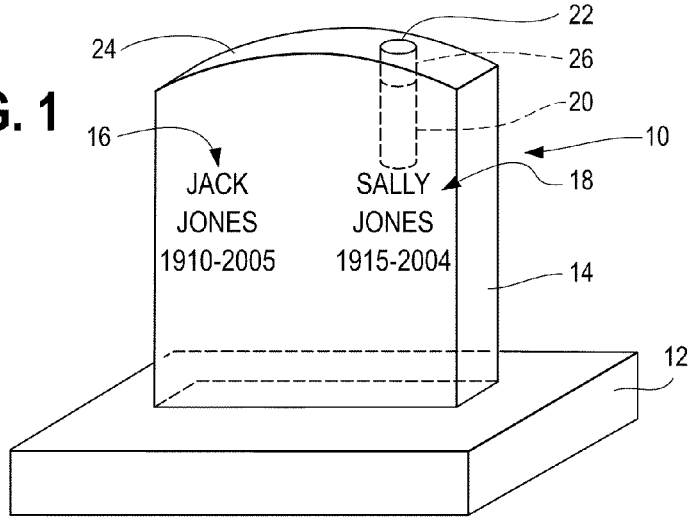
FIG. 1 is a perspective view of a memorial monument in accordance with the present invention, illustrating a chamber for holding the cremated remains of a deceased at the top of the headstone forming the monument.

FIG. 1 discloses a monument 10 of the type typically used to memorialize or mark a burial site. The monument 10 includes an above-ground base 12 supporting a headstone 14 as is known in the monument art.

In the embodiment shown in FIG. 1, the headstone 14 includes the names 16, 18 of two deceased individuals whose lives are memorialized by the monument. The deceased person identified by the name 16 on the left side of the headstone 14, as viewed in FIG. 1, is interred or buried in the earth ahead of the monument 10. The second person whose name 18 appears on the monument has been cremated.

To accommodate the cremated remains of the second deceased person, or additional cremated remains, the monument 10 in the embodiment of FIG. 1 includes at least one chamber or receptacle 20 formed in an inner portion of the headstone 14, the chamber 20 having an opening 22 at the top or upper portion 24 of the headstone. In the illustrated embodiment of FIG. 1, a tightly fitting removable cap or seal 26 extends into passage 20 to seal the chamber 20 as will be explained. In the embodiment of FIG. 1, the chamber 20 is cylindrical in shape, but it is understood that chamber 20 may be of other configurations such as square, rectangular, or the like. Also, as indicated above, more than one chamber 20 may be formed in monument 10, if desired.

The chamber 20, in an embodiment, is dimensioned to hold a crematory urn (not shown). Alternatively, the chamber 20 can be dimensioned to hold the ashes of a cremated deceased person without an urn.

The upper portion of chamber 20 adjacent the top portion 24 of headstone 14 is accessible for placement of a crematory urn or ashes into chamber 20. Once the urn or ashes are placed in chamber 20, cap or seal 26 is inserted into the top of chamber 20. In an embodiment, cap 26 can be force fit into the top of chamber 20 so that the cap cannot be removed, other than drilling out the cap 26. In this embodiment, the urn and/or cremated remains are permanently lodged in chamber 20.

In an alternate embodiment, the cap or seal 26 is removably inserted into the opening 22 of chamber 20 after the cremated remains are placed in chamber 20, to allow the crematory urn or cremated remains to be removed by a family member if desired. In this embodiment, the invention contemplates that cap or seal 26 will engage the inner walls of chamber 20 through a sturdy lock and key system, or equivalent security system, to prevent unwanted removal of cap or seal 26 by vandals or the like.

Figure 2:
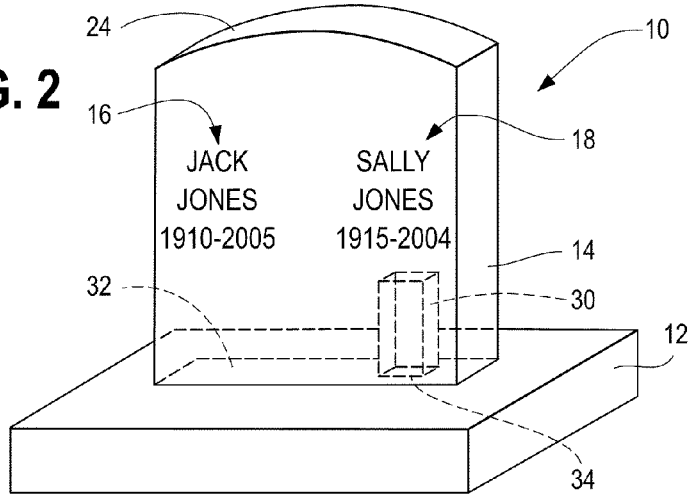
FIG. 2 is a perspective view of a memorial monument in accordance with the present invention, wherein the chamber for holding the cremated remains of a deceased is at a lower portion of the headstone and just above the above-ground base of the monument.

FIG. 2 shows an alternate embodiment of the present invention, wherein like elements shown in FIG. 1 are identified by the same numerals. In the embodiment of FIG. 2, one chamber 30, or possibly multiple chambers 30, are located in the bottom inner portion 32 of headstone 14, and each chamber 30 has an opening 34 providing access from bottom portion 32 of headstone 14 into chamber 30. In this embodiment, chamber 30 is shown in a rectangular shape compared to the cylindrical shape of chamber 20 in FIG. 1. However, in keeping within the scope of the present invention, chamber 30 may be any suitable shape.

Referring to FIG. 2, in use, a crematory urn (not shown), or the cremated remains of a deceased, are inserted into chamber 30 prior to headstone 14 being assembled onto base 12. Normally, the weight of headstone 14 will provide a seal at opening 34 of chamber 30, keeping the cremated remains secure in the chamber. If desired, a cap or seal 26 such as shown in FIG. 1 can be inserted and locked into position at opening 34 just after the cremated remains are placed into chamber 30. In addition, if desired a latching mechanism (not shown) can be placed between headstone 14 and base 12, preventing access to the contents of chamber 30 in case of acts of vandalism.

Figure 3:
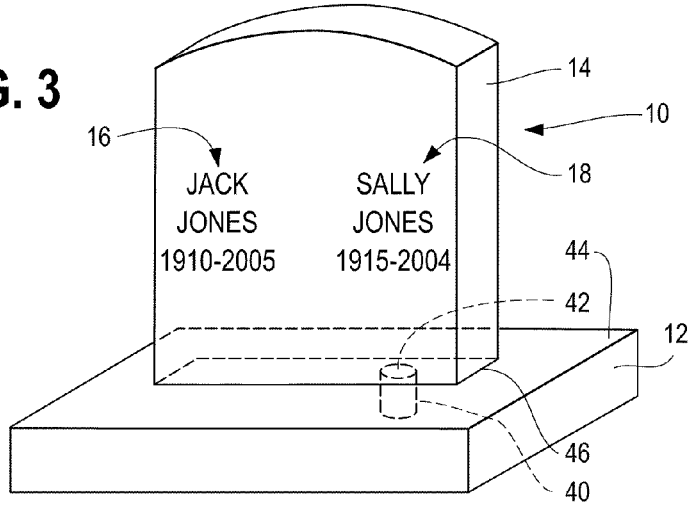
FIG. 3 is a perspective view of a memorial monument in accordance with the present invention, wherein the chamber for holding the cremated remains of a deceased is in the above-ground base of the monument.

In the embodiment of FIG. 3, wherein like elements shown in FIGS. 1 and 2 are identified by the same numerals, one or more chambers 40 are located in an inner portion of the above-ground base 12. An opening 42 in the upper portion 44 of base 12 provides access to chamber 40. The chamber 40 is shown as having a cylindrical shape, but can be of any suitable shape to hold a crematory urn or the cremated remains of a deceased, as desired.

In the embodiment of FIG. 3, an urn containing the cremated remains of a deceased, or the cremated remains, are placed in chamber 40 before headstone 14 is mounted and fixed in place on base 12. When the headstone 14 is mounted on the base 12, the bottom of headstone 46 covers and seals opening 42 and chamber 40 with the cremated remains securely lodged in chamber 40. The various chambers 20, 30 and 40 of FIGS. 1-3 can also be adapted to hold a DNA sample of the cremated individual for possible medical use by other family members. In such case, it is contemplated that the respective chamber will be accessible.

Figure 4:
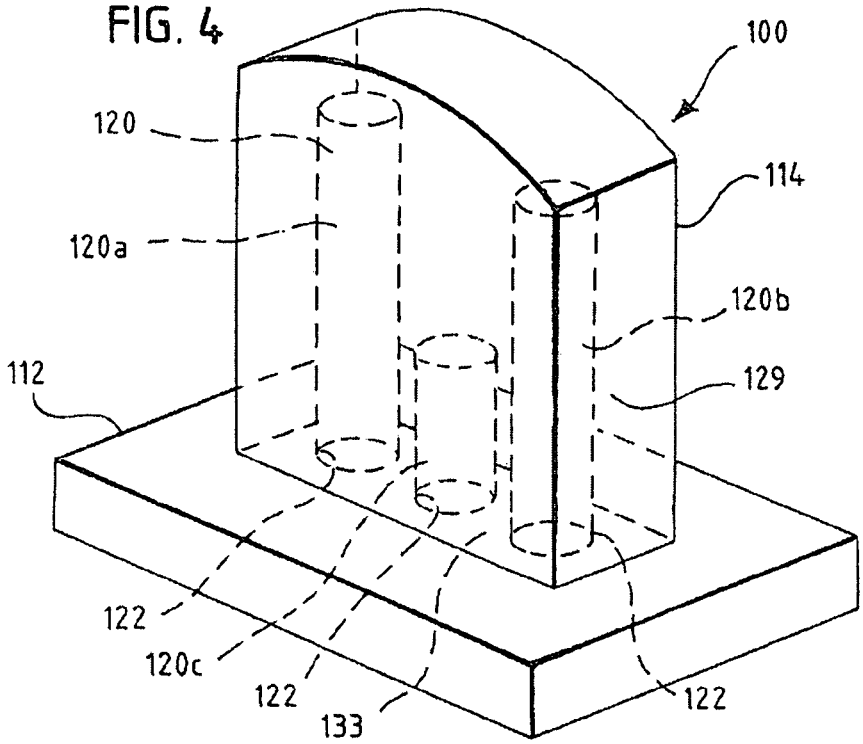
FIG. 4 is a perspective view of a second embodiment of the memorial monument of the present invention, illustrating three chambers for holding both the cremated remains and the DNA material of the deceased in the headstone of the monument.

FIG. 4 illustrates a second embodiment 100 of the monument. The monument 100 again includes an above-ground base 112 and a headstone 114. To accommodate the cremated remains of a deceased person or other previously living being or creature, as described for the previous embodiment, the monument 100 includes chambers or receptacles 120*a*, 120*b* formed in an inner portion of the headstone 114. The illustrated embodiment of FIG. 4 further includes at least one chamber or receptacle 120*c* to hold DNA material of a deceased person or previously living being in a sterile environment.

As shown in FIG. 4, each chamber 120*a*, 120*b*, and 120*c* is formed in an inner portion 129 of the headstone 114. Each chamber 120 has an opening 122 providing access from a bottom portion 133 of headstone 114 into each chamber 120 when headstone 114 is tilted on or lifted off of base 112. Containers 130, 132 (FIG. 5) are dimensioned to fit inside chambers 120*a*, 120*b* and 120*c* to hold cremated ashes or DNA material. In the illustrated embodiment, the chambers 120*a*, 120*b*, and 120*c* have a cylindrical shape, but it is understood that the chambers for both the ashes and the DNA material may be of other suitable configurations such as square, rectangular or the like. Additionally, in other embodiments similar to that previously described for FIG. 2, the cremated remains or the DNA material may be placed in the chambers 120*a*, 120*b* and/or 120*c* before the headstone 114 is mounted on the base 112.

In an embodiment, the chambers 120 may be dimensioned inside the headstone to hold the ashes of a cremated deceased person without an urn or separate container 130. The container 130 for a deceased person's ashes may be manufactured from plastic or other similar material. The container 132, adapted to enclose the DNA material of a deceased person, may be manufactured from glass or other similar material which can effectively provide and maintain a sterile and permanent environment inside the container 132.

Figure 5:
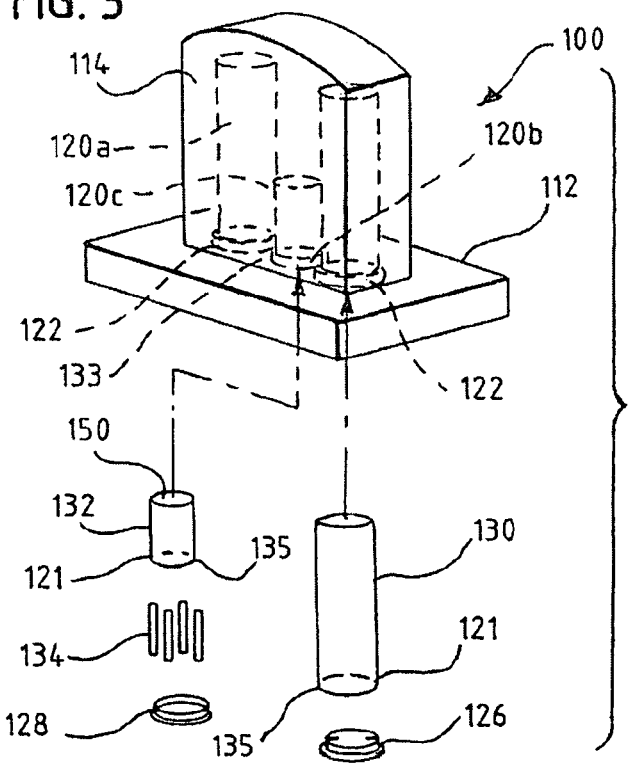
FIG. 5 is an exploded view of the memorial monument shown in FIG. 4, illustrating the detail of the container for holding a deceased's ashes and the container enclosing sterile test tubes for holding the DNA material of one or more deceased persons.

As shown in FIG. 5, a tightly fitting removable cap or seal 126 extends into passage 122 to seal container 130 or 132 inside the chambers 120*a*, 120*b* and/or 120*c*. In an embodiment, the seal 126 can be force fit into the passage 122 so that the cap cannot be removed other than by drilling out the cap 126. In this embodiment, the container 130 holding the cremated remains is permanently lodged in the chambers 120*a*, *b*. In an alternate embodiment, the cap or seal is removably inserted into the opening 122 of chambers 120*a* and 120*b* after the cremated remains are placed in chambers 120 to allow the urn or cremated remains to be removed by a family member if desired.

Figure 6:
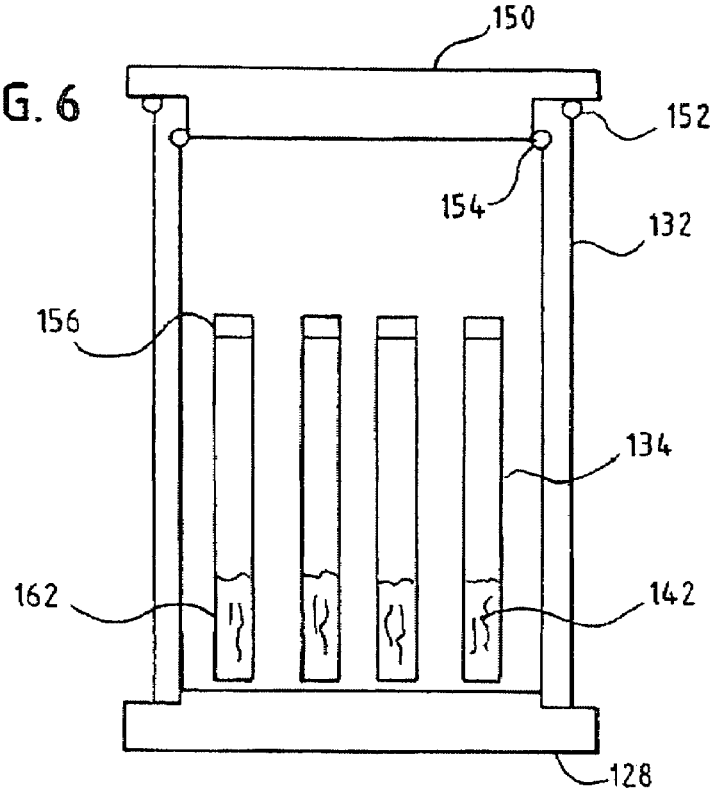
FIG. 6 is a detail view of one of the containers shown in FIG. 5 to hold the DNA material of one or more deceased persons and illustrating a plurality of sterile test tubes enclosed inside the container via a sterile, air-tight seal.

Referring again to FIGS. 4 and 5, at least one of the chambers 120*c* is adapted to hold DNA material from one or more deceased persons. To maintain a sterile environment, the container 132 is made of glass or other similar material suitable to maintaining sterility in the container. The cap or seal 128 extends into passage 121 of container 132 to seal container 132. Cap 128 has an extended diameter (FIG. 6) so that cap 128 may also seal container 132 in chamber 120*c* by engaging the chamber wall surrounding opening 122. At least one test tube 134 is enclosed in the container 132 to hold the DNA material 142. Both the test tubes 134 and the glass container 132 provide a sterile environment and an air-tight container for the DNA material 142 (FIG. 6). In the illustrated embodiment of FIG. 6, cap 150 closes the upper end of container 132, and double seals 152, 154 between the top of container 132 and cap 150 prevent air and contaminants from entering the interior of container 132. Seals 150 and 152 are preferably made of a material that will maintain its composition and sealing qualities without degradation for many years. Container 132 is configured to hold a plurality to test tubes 134, as desired by a user. Seals 156 seal the top of each test tube after DNA 142 has been inserted in the test tubes. Seals 156 are also made of a non-degrading material, and possibly are made of the same material as seals 152, 154. In an embodiment, packaging material may be used to reduce movement of the test tubes 134 inside the container 132.

In use, for the embodiment shown in FIGS. 4-6, containers 130, 132 containing cremated remains and/or DNA, respectively, are inserted into the chambers 120 through passages 122 inside the headstone 114 prior to headstone 114 begin assembled onto base 112. Caps 126, 128 are inserted and locked into place at opening 121, 135 of containers 130, 132, respectively, and the containers holding the cremated remains or DNA material are placed into the respective chambers 120*a*, 120*b*, and/or 120*c*. When the bottom 133 of headstone 114 is mounted on the base 112, the containers 130 and 132 inside chambers 120 are not visible when viewing the headstone from the outside. The sealed containers 130 and 132 inside chambers 120 remain concealed from view until the headstone is pivoted or lifted out of its supported upright position on base 112 to allow access to the chambers 120 through passages 122, and to the containers 130, 132 therein.

Figure 7:
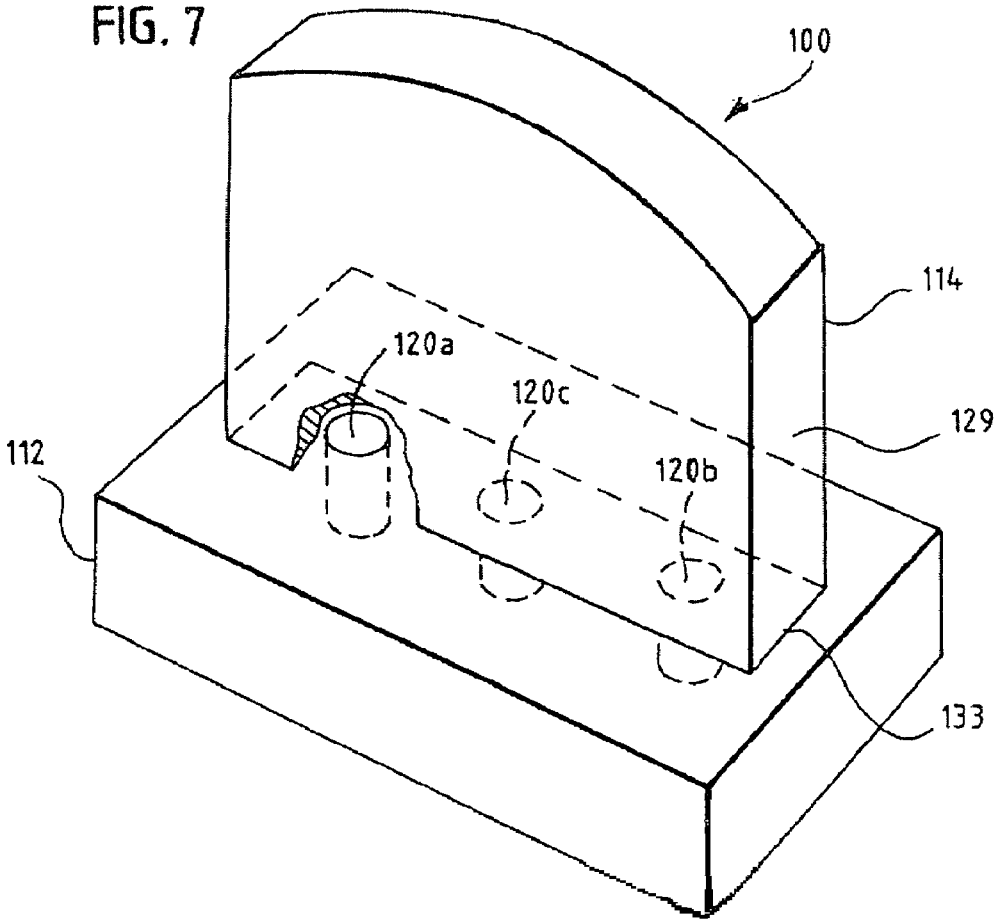
FIG. 7 is a perspective view of an embodiment of the invention shown in FIGS. 4-6 where the chambers holding the cremation ashes and the sterile DNA container are in the above-ground base, with the bottom of the headstone forming a seal over the openings to the chambers.

FIG. 7 illustrates another embodiment of the invention shown in FIGS. 4-6, wherein chambers 120*a*, 120*b* and 120*c* are located in the above ground base 112. The cremation urn 130, or the cremation ashes directly, are placed in one of the chambers 120*a*, 120*b*, in the base 112 prior to placement of headstone 114 on top of base 112. Additionally, sealed container 132 holding the DNA of one or more previously living persons or creatures, as previously described, is placed in chamber 120*c* prior to lowering headstone 114 in place on base 112. Each of the chambers 120*a*, 120*b* and 120*c* are appropriately sealed using the materials and techniques described above in connection with the embodiment of FIGS. 4-6. After the ashes, or urn or container 130 and the DNA container 132 are placed in their respective chambers 120*a*, 120*b*, and 120*c*, the headstone 114 is set in place on base 112 such that bottom surface 133 of headstone 114 covers and conceals from sight each chamber 120*a*, 120*b* and 120*c*. When it becomes necessary or desirable to retrieve the DNA samples 142 from the chamber 120*c* in base 112, headstone 114 is tilted on or lifted from base 112 to expose the opening of chamber 120*c*, allowing access to DNA container 132. The seals holding container 132 in chamber 120*c* are broken, and the container is removed from the base 112. Since container 132 is itself sealed from the elements, the container can be taken to a sterile laboratory or other facility for examination. After such examination, the DNA container is resealed in the sterile facility, and placed back and sealed in chamber 120*c* as previously described.

As is apparent, the various embodiments of the present invention provide a combination memorial park monument comprising a headstone and base, and include at least one chamber for the secure placement of the cremated remains of a deceased individual, and in another embodiment, a secure sterile chamber for holding DNA material. The monument 10, 100 therefore, allows two, or more if desired, deceased individuals to lie together in their eternal resting place in situations where one or more persons desire to be interred in the earth at the end of their days, and one or more persons in loving relationship with the other or others decide upon cremation of their earthly form. The present invention also includes a sterile environment for the secure placement of DNA from one or more deceased individuals or creatures.

The foregoing description of embodiments of the invention has been presented for purposes of illustration and description, and is not intended to be exhaustive or to limit the invention to the precise forms disclosed. The description was selected to best explain the principles of the invention and practical application of these principle to enable others skilled in the art to best utilize the invention in various embodiments and various modifications as are suited to the particular use contemplated. It is intended that the scope of the invention not be limited by the specification, but be defined by the claims set forth below.

I claim:

1. A combination memorial and columbarium for marking a burial site and for holding cremated remains of a previously living being, comprising:

a. a headstone for marking the burial site;

b. an above ground base supporting the headstone;

c. at least two chambers individually formed in an interior portion of one of said headstone and said above ground base;

d. each of the at least two chambers having an opening providing access to each of said at least two chambers;

e. at least one of said at least two chambers adapted to securely hold the cremated remains of the deceased previously living being; and f. at least one of said at least two chambers being adapted to securely and, in a sterile environment, hold DNA material of a deceased previously living being;

wherein the at least one chamber for holding DNA material further comprises at least one glass container inside the chamber, at least one test tube in said glass chamber, said glass container having an opening to provide access to at least one test tube, the at least one test tube adapted to hold the DNA material in said sterile environment.

2. The combination memorial and columbarium of claim 1 wherein the at least one test tube for holding the DNA material further comprises a sterile, air-tight seal in an opening of each test tube, the seal preventing contamination of the DNA material.

3. The combination memorial and columbarium of claim 1 further including at least one seal in said opening of said glass container, the seal preventing access to the container, the seal adapted to provide and maintain a sterile environment inside the glass container.

4. The combination memorial and columbarium of claim 1 wherein each of the at least one test tube further comprises an opening to provide access to an interior of the test tube, each of the at least one test tube further including a seal in said opening of said at least one test tube, the seal preventing access to the at least one test tube, the seal adapted to provide and maintain a sterile environment inside the at least one test tube until the seal is broken.

5. A combination memorial and columbarium for marking a burial site and for holding cremated remains of a deceased previously living being, comprising:

a. a headstone for marking the burial site;

b. an above ground base supporting the headstone;

c. at least two chambers individually formed in an interior portion of said headstone, said chambers formed in a lower portion of said headstone;

d. each of the at least two chambers having an opening providing access to each of said at least two chambers, said opening disposed in a bottom surface of said headstone;

e. at least one of said at least two chambers adapted to securely hold the cremated remains of the deceased previously living being; and f. at least one of said at least two chambers being adapted to securely and, in a sterile environment, hold DNA material of a deceased previously living being;

said base forming a seal over said openings to said chambers such that said at least two chambers are hidden from view until said headstone is moved relative to said base.

6. The combination memorial and columbarium of claim 5, further including a seal in each opening of the at least two chambers, each seal preventing air and contaminants from accessing at least one of the at least two chambers.

7. The combination memorial and columbarium of claim 5, further including a removable seal in the opening of each of the least two chambers, each removable seal preventing access to the at least two chambers when the seal is disposed in the opening.

8. The combination memorial and columbarium of claim 5 wherein the headstone further comprises indicia identifying at least two deceased individuals.

9. The combination memorial and columbarium of claim 8 wherein one of said at least two deceased individuals is provided with an earthen interment and the other of said at least two individuals is provided with cremation.

10. The combination memorial and columbarium of claim 5 wherein said above ground base includes a top portion, said top portion of said base providing said seal over each opening of said at least two chambers.

11. The combination memorial and columbarium of claim 5 wherein each opening for each of the at least two chambers in the headstone rests on the base, each opening concealed from view when the headstone is in an upright position on the base.

12. The combination memorial and columbarium of claim 5 wherein the at least one chamber for holding cremated remains is further adapted to hold a container for containing and securely enclosing cremated remains inside the chamber.

13. A combination memorial and columbarium for marking a burial site and for holding cremated remains of a previously living being, comprising:

a. a headstone for marking the burial site;

b. an above ground base supporting the headstone;

c. at least two chambers individually formed in an interior portion of one of said headstone and said above ground base, said chambers formed in a portion of said one of said headstone and said above ground base adjacent the other of said headstone and said above ground base;

d. each of the at least two chambers having an opening providing access to each of said at least two chambers, said opening disposed in a surface of said one of said headstone and said above ground base adjacent the other of said headstone and said above ground base;

e. at least one of said at least two chambers adapted to securely hold the cremated remains of the deceased previously living being; and f. at least one of said at least two chambers being adapted to securely and, in a sterile environment, hold DNA material of a deceased previously living being;

g. the other of said headstone and said above ground base forming a seal over said openings to said chambers in said one of said headstone and said above ground base such that said at least two chambers are hidden from view until said headstone is moved relative to said base.

14. The combination memorial and columbarium of claim 13 wherein the at least one chamber for holding DNA material further comprises at least one glass container inside the chamber, at least one test tube in said glass container, said glass container having an opening to provide access to at least one test tube, the at least one test tube adapted to hold the DNA in said sterile environment.

15. The combination memorial and columbarium of claim 13 wherein the at least two chambers are formed in said above ground base, and wherein said openings to said at least two chambers are disposed in a top surface of the base.

16. The combination memorial and columbarium of claim 15, wherein said headstone forms a seal over each opening.

* * * * *